United States Patent [19]

Funke

[11] Patent Number: 4,572,056

[45] Date of Patent: Feb. 25, 1986

[54] PLUNGER OR FLOATING PISTON PUMP

[75] Inventor: Herbert Funke, Krailling, Fed. Rep. of Germany

[73] Assignee: Saphirwerk Industrieprodukte AG, Nidau, Switzerland

[21] Appl. No.: 669,443

[22] Filed: Nov. 8, 1984

Related U.S. Application Data

[63] Continuation of Ser. No. 378,741, May 17, 1982, abandoned.

[30] Foreign Application Priority Data

Jun. 3, 1981 [DE] Fed. Rep. of Germany ..... 3122091

[51] Int. Cl.[4] ..... F01B 31/10; F16J 15/18; F04B 39/02

[52] U.S. Cl. ..... 92/86; 92/86.5; 92/170; 92/168; 417/568

[58] Field of Search ..... 417/568, 521; 92/170, 92/168, 86, 86.5

[56] References Cited

U.S. PATENT DOCUMENTS

| | | | |
|---|---|---|---|
| 2,910,007 | 10/1959 | Buri | 92/168 |
| 2,916,998 | 12/1959 | Miller | 417/568 |
| 3,022,685 | 2/1962 | Armacost | 417/568 |
| 3,125,963 | 3/1964 | Whitley et al. | 97/168 |
| 3,288,079 | 11/1966 | Kling | 417/568 |
| 3,301,189 | 1/1967 | Kling | 417/568 |
| 3,372,647 | 2/1968 | Kling | 417/568 |
| 3,495,544 | 2/1970 | Enggle | 417/568 |
| 3,507,584 | 4/1970 | Robbins, Jr. | 417/568 |
| 4,173,437 | 11/1979 | Leha | 417/521 |
| 4,197,287 | 4/1980 | Schneider | 92/110 |
| 4,389,163 | 6/1983 | Magnusson | 417/2 |

*Primary Examiner*—William L. Freeh

*Attorney, Agent, or Firm*—Wood, Dalton, Phillips, Mason & Rowe

[57] ABSTRACT

The present invention relates to a plunger or floating piston pump which is particularly adapted for use as a small-size metering pump in performing chemical analyses. In a pump head casing there is disposed a plunger guide bushing made of a ceramic material in which a plunger made of sapphire is slidably guided permanently with extreme accuracy in relation to the bore in an annular seal, said annular seal itself cooperating with said plunger in such a way that there is no clearance between the plunger and said plunger guide bushing. In a modification of the invention, said displacement chamber is formed in a pump head liner which is mounted in said pump head casing. The pump head liner is made of a chemically inert material, preferably of a ceramic material.

2 Claims, 1 Drawing Figure

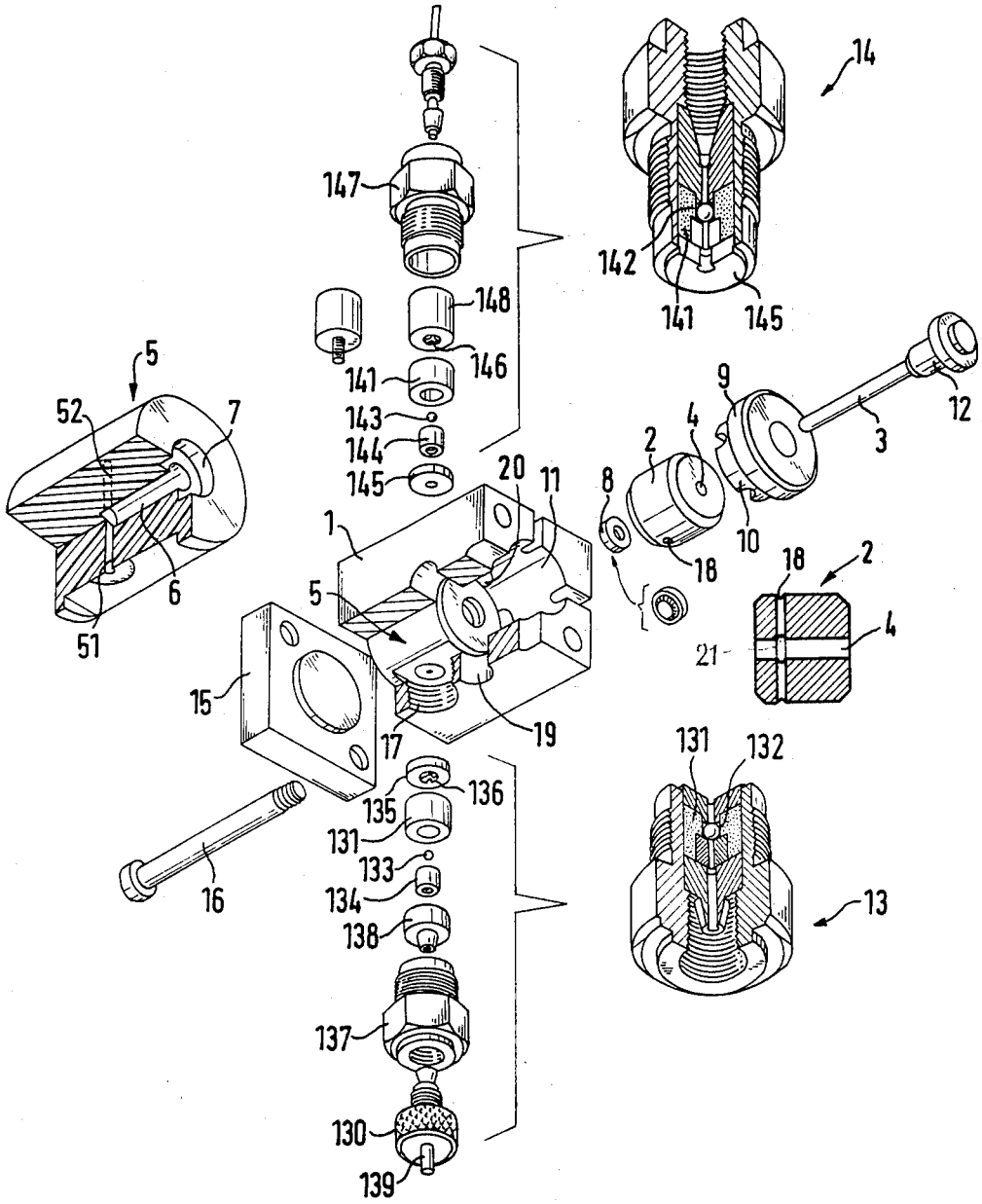
14
147
142
141
145
148
146
141
143
144
145
5
52
7
6
51
9
4
2
3
12
10
20
11
8
18
1
5
18
2
4
21
15
17
19
131
132
136
135
131
133
134
138
16
13
137
130
139

PLUNGER OR FLOATING PISTON PUMP

This is a continuation of application Ser. No. 378,741 filed May 17, 1982, now abandoned.

TECHNICAL FIELD OF THE INVENTION

The present invention relates to a plunger or floating piston pump comprising a pump head casing, a displacement chamber enclosed by said head casing, a rod-shaped floating piston made of sapphire having a diameter smaller than the diameter of said displacement chamber, an elastic annular seal disposed at the open end of said displacement chamber with said floating piston extending through said seal and a piston guide bushing fixedly mounted in said pump head liner on its side facing away from said displacement chamber.

BRIEF DESCRIPTION OF THE PRIOR ART

In a prior-art plunger pump, the pump plunger is not guided by means of the walls of the displacement chamber, it being, therefore, necessary to provide for the plunger to be guided at least by its annular seal in the manner described, for example, in U.S. Pat. No. 3,810,716, according to which said annular seal is made of an elastomeric material. However, should the plunger be subject to radial deflection in a way which is unavoidable in practice due to manufacturing tolerances, this means that the annular seal is constantly subjected to a kneading effect. This results in the material of the annular seal to be subject to fatigue and wear with the result that leaks may develop.

In order to obviate this drawback it has been proposed to provide an additional plunger guide bushing which is disposed on the side of the annular seal facing away from the displacement chamber and fixedly mounted in the pump head liner. It has been conventional to manufacture this plunger guide sleeve from reinforced polytetrafluoroethylene (PTFE) or polyimide. These materials are particularly suitable for this application because of their good chemical stability and their low friction when cooperating with the material of the plunger.

However, it has been found that the above-mentioned detrimental continuous deformation of the annular seal is not eliminated by a plunger guide bushing made of one of the materials mentioned, this being due to the fact that these materials are yieldable and not resistant to abrasion. Due to this yieldability, radial deflections of the plunger are still possible. In view of the insufficient wear resistance, the diameter of the plunger guiding hole of the plunger guide bushing tends to increase in the course of time, the result being that no accurate guiding action is ensured any longer and that an undesirable radial play will occur. At the same time, the development of a gap between the plunger and the plunger guide sleeve under the influence of the delivery pressure of the pump causes the annular seal to creep into the gap. This extrusion of the material of the annular seal results in a large increase in the rate of wear, the result being that the sealing function is lost and that leakage will develop.

OBJECT OF THE INVENTION

It is an object of this invention to provide plunger or floating-piston pumps of the general type indicated above which are designed in such a way as to permit prolonged operation without the risk of leakage developing.

SUMMARY OF THE INVENTION

According to the invention, this object is attained by providing a plunger guide bushing made of a ceramic material.

Due to the extreme hardness of the ceramic material, it is possible to ensure for long periods of operation that the plunger is guided with absolute accuracy and perfectly aligned to the bore of the annular seal and that the formation of a gap around the annular seal if practically eliminated. Thus, both flexing and extrusion of the material of the annular seal are precluded.

Principally, the fact that, according to this invention, components made of materials of equal hardness, e.g. sapphire and a ceramic material, which are in frictional contact are paired is in contrast to the basic rules of design engineering. Surprisingly, however, it has been found that it is just the materials mentioned which are capable of cooperating with wear being practically eliminated. The cause of these phenomena is obviously to be seen in the difference in the crystalline structure of sapphire, which is of a monocrystalline nature, and the ceramic material, which has a polycrystalline structure.

In DE-OS No. 25 15 229 it has been suggested to employ a ceramic material in making pump components which cooperate frictionally, e.g. pistons and displacement cylinders, but in this case it is not intended to employ a plunger or floating piston; on the contrary, the piston is intended slidingly to cooperate with the wall of the displacement chamber. The selection of a ceramic material for both the piston and the displacement cylinder is intended to improve the resistance to corrosive and abrasive media to be delivered. Any undissolved particles entering the guiding gap are expected to be disintegrated into extremely small particles of microscopic size due to their contact with the hard surfaces consisting of ceramic materials. However, in the plunger pump of the invention, no conditions exist which would permit this principle to be employed, since the guiding gap between the plunger and the plunger guide bushing is not contacted by the medium, this being so because the sealing ring is additionally provided between the displacement chamber and the plunger guide bushing. Nor are the plunger guide bushing and the plunger intended to pulverize any undissolved particles or particulate matter. Should the gradual development of leakage along the annular seal actually permit the medium to reach the plunger guide bushing, this will cause particles deposited or crystallizing on the plunger to be stripped off.

As shown in the periodical "Technische Mitteilungen", May 1968, No. 5, p. 233, it is also known to manufacture pistons or plungers of hardened steel which are provided with a sprayed-on wear protection coating consisting of aluminum oxide or a ceramic material or a hard alloy; however, pistons of this type are not intended for use in pumps having a piston guide bushing but they should be used in combination with an elastic cuff seal. Moreover, such pistons are not made of monocrystalline sapphire material.

Considering the possibility that prolonged operation of a plunger pump according to the invention results in the seal being worn to such an extent that liquid is permitted to find its way to the plunger guide sleeve or even into it, this invention provides a modification according to which the plunger guide bushing is provided in the vicinity of its end facing the seal with a peripheral internal groove and a radial or transverse bore crossing said groove, said bore preferably being arranged in a vertical position. The upper end of said transverse bore makes it possible, for example, by means of a syringe or by means of flexible tubes whose ends are tightly fitted into the ends of the bore or by means of a wick, to introduce from time to time or continuously a rinsing liquid for the purpose of flushing out any abraded seal particles or crystalline particles which may have found their way to said inner groove and/or of completely precluding any undesirable crystallizing-out of salts from the lubricating film formed by the medium to be delivered. The flow of said rinsing liquid or of liquid entrained by the plunger up to said internal groove may then be discharged via the bottom end of said transverse bore or may be interrupted as desired.

According to another preferred modification of this invention, a pump head liner made of a chemically inert material is provided in the pump head, this arrangement making it possible, on the one hand, to prevent a liquid, for example a chemically agressive liquid, from coming into contact with metallic components and thus damaging the pump and, on the other hand, of preventing contamination of the liquid to be delivered. The materials of which this pump head liner may be made preferably include ceramic materials, particularly aluminum oxide ($Al_2O_3$). The use of a ceramic material in this pump head liner affords the advantage that absolute dimensional stability of the surface of the displacement chamber is ensured and that such surface may be given an extremely smooth surface finish. In contrast to corresponding components made of special steel, gas or vapor bubbles which might be produced in the displacement chamber if cavitation occurs during operation of the pump will not adhere to said surface but will be discharged immediately.

BRIEF DESCRIPTION OF THE DRAWING

The invention and further particulars will be described more specifically hereinafter with reference to a preferred embodiment shown in the drawing.

The drawing shows a partially sectioned exploded view of an exemplary embodiment of a plunger or floating-piston pump according to the invention.

DETAILED DESCRIPTION OF A PREFERRED EMBODIMENT OF THE INVENTION

A pump head casing 1 is shown in the central part of the drawing. This casing is made of metal, e.g. stainless steel. It is provided with a central bore 11 having mounted therein a pump head liner 5.

Pump head liner 5 is made of a chemically inert material, e.g. polychlorotrifluoroethylene (CTFE) or polyvinylidene fluoride (PVDF), preferably, however, of $Al_2O_3$ ceramics. Pump head liner 5 is provided with a central bore forming a displacement chamber 6 to which there are connected two bores 51, 52 leading to an inlet valve 13 and an outlet valve 14, respectively.

Pump head liner 5 is provided at the outer end of displacement chamber 6 with an annular groove 7 having mounted therein an annular seal 8 in relation to which a floating piston or plunger 3 is reciprocated during operation of the pump. Annular seal 8 comprises an annular spring made of stainless steel or a special alloy available under the registered trade name "Hastalloy C" surrounded by a jacket made of a CTFE compound.

In addition, central bore 11 of pump head casing 1 has mounted therein a plunger guide bushing 2 made of a ceramic material, e.g. $Al_2O_3$. Said plunger guide bushing is provided with a central guide bore 4 in which, in operation, plunger 3 is reciprocating, being thereby accurately guided in relation to the bore of annular seal 8.

Piston 3 is made of sapphire. By means of a lapping operation it is possible to provide an extremely smooth and accurate surface finish of the peripheral surface of the plunger as well as of the wall of the guide bore of plunger guide bushing 2 with the result that there exists an extremely accurate fit between the plunger and the guide bore 4.

The diameter of plunger 3 is slightly smaller than the inner diameter of displacement chamber 6. The pump operates on the plunger pump principle, i.e. the plunger does not contact the wall of pump head liner 5 in order to preclude tilting or deflection of the plunger.

The end of plunger 3 facing the drive means is provided with a shrank ferrule 12 made of special steel and constructed in such a way that it remains freely movable in radial directions in the receiving member of the drive mechanisms (primary piston assembly) associated therewith.

Plunger guide bushing 2 is provided with a vertically extending transverse bore 18 crossing guide bore 4 and terminating in an internal groove 21. In pump head casing 1 there is also provided a transverse bore 20 which is in alignment with transverse bore 18 of plunger guide bushing 2. Said transverse bores 20 and 18 permit a flushing liquid to be introduced and discharged, respectively. Said internal groove 21 also serves as a trap for material abraded from the annular seal and permits liquid escaping through a leak to be discharged immediately and to interrupt any flow of liquid entrained along the plunger within the guide bushing. It is possible continuously or discontinuously to introduce the flushing liquid into the upper end of transverse bore 18 by injecting said liquid by means of flexible tube connections or a wick and to drain said liquid through the lower end of said transverse bore.

Pump casing 1 and the pump drive unit are held in assembly, for example, by means of a centering bushing 9 made of special steel and having a collar section 10 extending into the central bore 11 of pump head casing 1. This centering sleeve 9 constitutes an abutment for pump head liner 5 and plunger guide bushing 2, respectively.

The oppositely facing aperture of central bore 11 is closed by means of a pump head casing lid 15 which is secured to pump head casing 1 by means of bolts 16.

Extending transversely of central bore 11 are two threaded bores 17 adapted to accept valve bodies 137 and 147, respectively, belonging to inlet valve 13 and outlet valve 14.

Said valves are constructed as ball check valves provided with valve balls 133 and 143 respectively made of ruby cooperating with sapphire seats 134 and 144 provided with a seating edge produced by means of a lapping operation. Said seats are disposed in valve seat casings 131, 141 made of a ceramic material and provided with a stepped bore. The bore having the larger diameter receives the valve seat 134 or 144, respectively. The bore having the smaller diameter forms a ball guiding bore 132 or 142 receiving the valve ball associated therewith and having a ball abutment extending thereinto.

Disposed downstream of valve seat casing 131 of inlet valve 13 is a ball abutment seal 135 having a ball abutment extension 136 provided with a cross-shaped slot, said extension extending into said ball guide bore 132. A seal 135 provides a sealing action between the inlet valve unit and pump head liner 5. This ball abutment seal is made of a chemically inert material, e.g. polychlorotrifluoroethylene (CTFE) or polyvinylidenefluoride (PVDF) or ceramics in form of a sieve plate.

Disposed on the entry side of inlet valve 13 upstream of valve seat 134 is an inlet fitting adaptor 138 constructed as a sealing ring having a tapered projection adapted to have pressed thereonto a suction line 139 by means of a knurled screw 130.

Disposed on the outlet side between valve seat 144 and pump head liner 5 is an outlet sealing ring 145 also made of a chemically inert material such as CTFE or PVDF.

Provided on the outlet side of outlet valve 14 is an outlet fitting adaptor 148 having a ball stop extension 146 provided with a cross-shaped slot. Instead of said ball stop extension, there may be disposed in the bore of outlet fitting adaptor 148 a spring adapted to bias the ruby ball of outlet valve 14.

Valve seat housings 141 and 131 may be made of a ceramic material such as $A_2O_3$ ceramics. Those surfaces of said housings which are bound to come into contact with the liquid to be delivered are provided with a lapped finish so that there is no surface roughness to which gas bubbles might adhere or which might give rise to the formation of gas bubbles.

What is claimed is:

1. In a pump having a pump head casing with a bore, the improvement comprising:

a pump head liner positioned in said bore end having a displacement chamber open at one end and an annular groove at said one end;

a plunger guide bushing of ceramic material and having a guide bore and fitted in said casing bore in axial alignment with said pump head liner and adjacent to said one end of the pump head liner;

a resilient annular seal positioned in said annular groove; and a plunger of sapphire extending through said guide bore, said annular seal and into said displacement chamber through said open end thereof, the diameter of the plunger inner end in said displacement chamber being less than that of the displacement chamber to avoid contact therebetween, the plunger defining an outer end portion provided with means for transmitting axial forces only to the plunger in effecting axial reciprocation thereof whereby said plunger is guided for axial movement solely by the plunger guide bushing free of substantially all transverse forces, thereby providing accurate centered reciprocation of the plunger with extremely accurate play-free cooperation between the long-wearing, substantially equally hard ceramic and sapphire surfaces avoiding radial deflection of the plunger and flexing and wear of the annular seal; and said plunger guide bushing having means for flushing the guide bore comprising a peripheral internal groove and a transverse through bore crossing said groove in a radial direction adjacent the end of the plunger guide bushing facing said annular seal.

2. The pump of claim 1, characterized in that said pump head liner is made of an $Al_2O_3$ ceramic material.

* * * * *